United States Patent [19]

Svihlik

[11] 4,184,464

[45] Jan. 22, 1980

[54] RECIRCULATION GROOVE FOR HYDRAULIC LASH ADJUSTER

[75] Inventor: Frank C. Svihlik, Bellwood, Ill.

[73] Assignee: Stanadyne, Inc., Windsor, Conn.

[21] Appl. No.: 796,758

[22] Filed: May 13, 1977

[51] Int. Cl.[2] ..... F01L 1/24

[52] U.S. Cl. ..... 123/90.55; 123/90.57; 123/90.59

[58] Field of Search ..... 123/90.55, 90.56, 90.57, 123/90.58, 90.59, 90.48, 90.49, 90.51, 90.53

[56] References Cited

U.S. PATENT DOCUMENTS

| | | | |
|---|---|---|---|
| 2,580,380 | 1/1952 | Banker | 123/90.55 |
| 2,784,706 | 3/1957 | Humphreys | 123/90.55 |
| 2,790,430 | 4/1957 | Lowther | 123/90.55 |
| 2,908,260 | 10/1959 | Bergmann | 123/90.55 X |
| 2,938,508 | 5/1960 | Papenguth | 123/90.59 |
| 2,942,595 | 6/1960 | Bergmann et al. | 123/90.57 X |
| 3,025,842 | 3/1962 | Van Slooten | 123/90.58 |
| 3,124,114 | 3/1964 | Voorhies | 123/90.55 |
| 3,670,707 | 6/1972 | Guido | 123/90.57 |
| 3,861,365 | 1/1975 | Zink | 123/90.57 X |
| 3,897,761 | 8/1975 | Fleischer et al. | 123/90.55 |

FOREIGN PATENT DOCUMENTS

| | | | |
|---|---|---|---|
| 1233202 | 1/1967 | Fed. Rep. of Germany | 123/90.55 |

*Primary Examiner*—Charles J. Myhre
*Assistant Examiner*—Jeffrey L. Yates
*Attorney, Agent, or Firm*—Kinzer, Plyer, Dorn & McEachran

[57] ABSTRACT

A hydraulic lash adjuster includes a body having a closed end, a chamber and an open end. A hollow plunger is positioned within the body chamber and has a portion extending outwardly therefrom. A high pressure chamber is formed between the closed end of the body and the plunger and a spring is positioned within the high pressure chamber to urge the plunger outwardly from the body. There are aligned fluid passages in the body and plunger to permit oil to pass into the hollow plunger from the exterior of the body. There is an additional fluid passage in the plunger, positioned closer to the high pressure chamber than the body fluid passage, to direct oil passing from the high pressure chamber along the exterior of the plunger back into the plunger interior.

2 Claims, 3 Drawing Figures

RECIRCULATION GROOVE FOR HYDRAULIC LASH ADJUSTER

SUMMARY OF THE INVENTION

The present invention relates to hydraulic lash adjusters and in particular to an oil recirculation passage in the lash adjuster plunger.

A primary purpose of the invention is to provide an oil passage between the hollow interior of the plunger and the exterior thereof, closely adjacent the lash adjuster high pressure chamber, to direct oil from the chamber back into the plunger interior.

Another purpose is an oil recirculation passage in a lash adjuster of the type described which retains oil within the lash adjuster plunger.

Another purpose is a lash adjuster of the type described including means for positively directing oil escaping from the high pressure chamber under load back into the plunger supply chamber.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERED EMBODIMENT

Figure 1:
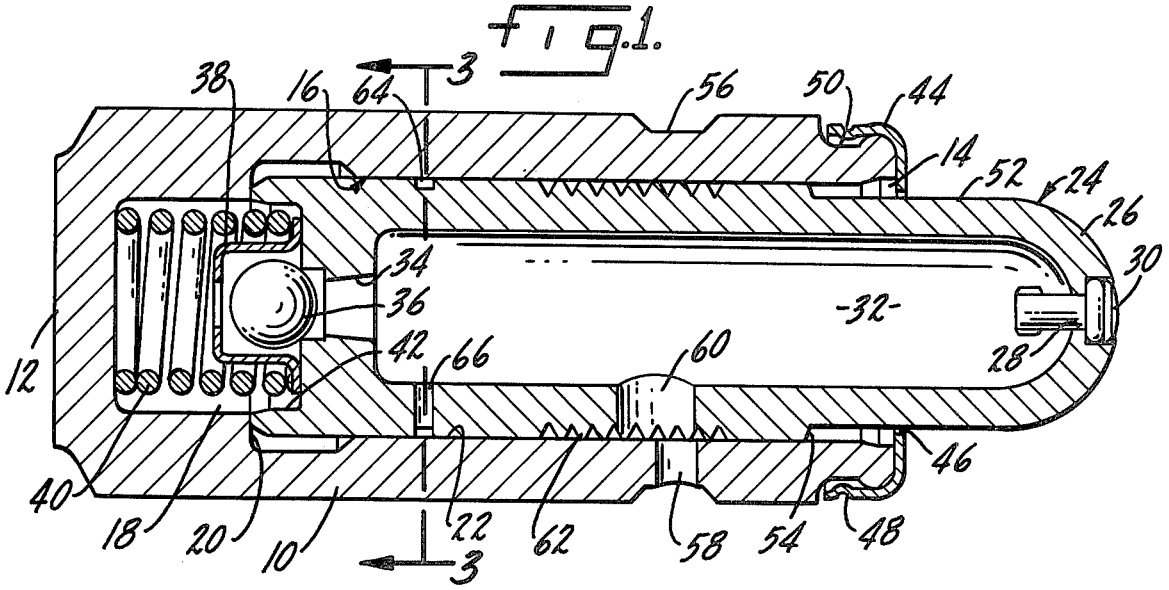
FIG. 1 is an axial section through a lash adjuster of the type described.
Figure 2:
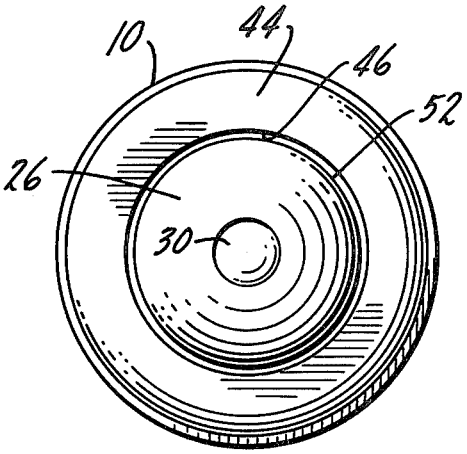
FIG. 2 is an end view of the lash adjuster.

The hydraulic lash adjuster disclosed herein may have application in four cylinder overhead cam type engines, although obviously the structure has wider utility. With the advent of overhead cam lash adjuster hydraulic units, particularly in reduced weight small size engines, the reduction in size of the lash adjuster has created a problem in maintaining sufficient oil volume on the inside of the plunger to compensate for plunger travel on those unit that bleed down when the engine is shut down. The present lash adjuster provides a means for positively directing oil escaping from the high pressure chamber under load back to the plunger supply chamber. Such a recirculation passage provides self contained lash adjuster units in that the oil supply will stay within the lash adjuster and will not bleed down or flow out of the lash adjuster when the engine is not in use.

In the drawing, the lash adjuster includes a generally cylindrical body 10, for example formed from sintered powdered metal, having a closed end 12 and an open end 14. As is conventional, the lash adjuster will be seated within a bore or opening in the engine head. A chamber 16 is formed within body 10 and includes a portion of reduced diameter 18. A shoulder 20 is formed between the portion 18 and a portion 22 of larger diameter forming the major part of the body chamber.

A steel plunger 24 is positioned within body chamber 16 and has an exterior rounded nose 26 which will be in engagement with the engine finger follower. There may be a small opening 28 in the end of the plunger and a relief pin or relief valve 30 is positioned in the opening to provide for the escape of air from within the plunger chamber and in some applications to meter the flow of oil. Plunger 24 is hollow and has an interior chamber 32 which, through a small passage 34, is in communication with high pressure chamber 18. A ball valve 36, held in position by a retainer 38, controls the passage of fluid from plunger chamber 32 to high pressure chamber 18. A coil spring 40 is positioned within chamber 18 and is bottomed upon closed body end 12. Spring 40 extends within a small recess 42 formed in the interior end of plunger 24 and the spring partially encircles retainer 38. Plunger spring 40, as is conventional, will bias or urge the plunger outwardly from the body. Inward movement of the plunger in the body, as caused by the finger follower, is limited by contact between that portion of the plunger circumferentially exterior of recess 42 and body shoulder 20.

Body retainer 44 has a central opening 46, with the retainer being positioned over the open end of the body and having a bead-like portion 48 which is positioned within an exterior groove 50 on the body. The exterior portion of the plunger is reduced in size, as at 52, forming a plunger shoulder 54 which will contact retainer 44 when the plunger moves outwardly from the body; thus, the body retainer secures the plunger within the body.

There may be an oil groove 56 on the exterior of the body and it communicates with the body interior through a passage 58. There is a passage 60 formed in plunger 24 which is in communication with plunger chamber 32 and an exterior series of axially spaced serrations 62 on the plunger exterior. Oil from the engine pump, through the oil galleries of the engine, flows to groove 56, through passage 58, serrations 62 and then through passage 60 into the interior of the plunger.

Figure 3:
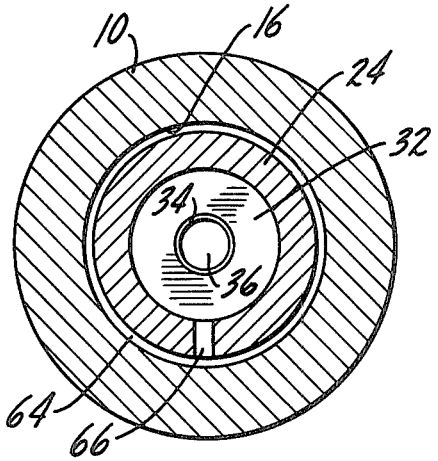
FIG. 3 is a section along plane 3—3 of FIG. 1.

An oil recirculation groove 64, shown in detail in FIG. 3, is formed on the exterior of the plunger and is in communication with the plunger interior through an opening 66. It is important to note that groove 64 and passage 66 are closer to the high pressure chamber 18 than groove 56 and passage 58 and are closely adjacent the closed end of the plunger.

In operation, oil is supplied from the engine pump to the interior of the plunger and the pressure in plunger chamber 32 and high pressure chamber 18 is equalized by flow through passage 34 past ball valve 36. Tests have indicated that because of the reduced size of the lash adjuster and hence the small volume of oil actually contained within the unit that a loss of oil can be critical relative to maintaining proper operation of the lash adjuster. Whenever an engine is shut down at least some of the lash adjusters will be stopped on the lift of the cam and these lash adjusters will bleed down and oil in the high pressure chamber does not necessarily return to the main plunger chamber of the supply chamber, but passes along the outer diameter of the plunger and then out passage 58 and groove 56. The addition of groove 64 and passage 66 provides a positive return for oil escaping from the high pressure chamber. The described recirculation passage must be closer to the high pressure chamber than the body passage 58 so as to prevent the oil escaping from the high pressure chamber from reaching the body where it would then flow back to the engine supply.

Although the invention has been described in connection with a hydraulic lash adjuster, it is also applicable to tappets and valve lifters.

Whereas the preferred form of the invention has been shown and described herein, it should be realized that there may be many modifications, substitutions and alterations thereto.

The embodiments of the invention in which an exclusive property or privilege is claimed are defined as follows:

1. An engine valve train component which is operable in either a horizontal or vertical attitude, comprising:

a body having a closed end, a chamber and an open end;

a hollow plunger positioned within said chamber and having a portion extending outwardly through said body open end, a high pressure fluid chamber being formed between said body closed end and said plunger, said plunger having a closed interior end, a passage through said closed interior end, and a valve member controlling the passage of fluid through said closed interior end passage;

a relief valve in the exterior end of said plunger in communication with the hollow interior thereof;

a spring positioned in said high pressure fluid chamber;

fluid passage means in said body in communication with the exterior of said plunger;

a first unrestricted fluid passage in said plunger connecting the interior of said plunger with said body fluid passage means; and a second unrestricted fluid passage in said plunger connecting the interior thereof with the exterior, said second fluid passage including a circumferential groove on the exterior of said plunger and an opening extending between said groove and said plunger interior, said second fluid passage being closer to said high pressure chamber than said body fluid passage means and being located directly adjacent to said plunger closed interior end; with the portion of the plunger exterior located between the second fluid passage and the body fluid passage means being sized so as to fit closely against the body in substantially a fluid sealing relation wherein entrained air can flow between the plunger and body to escape out the open end of the body while fluid is prevented from passing between the plunger and body.

2. The structure of claim 1 further characterized in that said first fluid passage includes a plurality of serrations on the exterior of said plunger generally in alignment with said body fluid passage means.

* * * * *